US009329555B2

(12) United States Patent
Motoi et al.

(10) Patent No.: US 9,329,555 B2
(45) Date of Patent: May 3, 2016

(54) SHEET PROCESSING APPARATUS AND IMAGE FORMING APPARATUS

(75) Inventors: Norio Motoi, Moriya (JP); Kenji Toppada, Noda (JP); Hiroki Hommochi, Moriya (JP); Yoshihiko Kitahara, Ushiku (JP)

(73) Assignee: Canon Finetech Inc., Misato-shi (JP)

( * ) Notice: Subject to any disclaimer, the term of this patent is extended or adjusted under 35 U.S.C. 154(b) by 548 days.

(21) Appl. No.: 12/892,418

(22) Filed: Sep. 28, 2010

(65) Prior Publication Data

US 2011/0081185 A1 Apr. 7, 2011

(30) Foreign Application Priority Data

Oct. 2, 2009 (JP) ..... 2009-231018

(51) Int. Cl.

*G03G 15/00* (2006.01)
*B65H 29/60* (2006.01)
*B65H 35/04* (2006.01)

(52) U.S. Cl.

CPC ..... *G03G 15/6582* (2013.01); *B65H 29/60* (2013.01); *B65H 35/04* (2013.01); *B65H 2301/33312* (2013.01); *B65H 2301/5152* (2013.01); *B65H 2801/27* (2013.01); *G03G 2215/00818* (2013.01)

(58) Field of Classification Search

CPC ..... B65H 45/04; B65H 2301/438; B65H 2301/4381; B65H 2301/44822; G03G 2215/00417; G03G 2215/00421; G03G 2215/00426; G03G 2215/00827; G03G 2215/00936; G03G 2215/00818

USPC ..... 399/407, 408; 271/902

See application file for complete search history.

(56) References Cited

U.S. PATENT DOCUMENTS

| | | | | |
|---|---|---|---|---|
| 5,090,673 | A | 2/1992 | Kitahara et al. | |
| 6,276,677 | B1 | 8/2001 | Hommochi et al. | |
| 6,361,036 | B1 * | 3/2002 | Nakazawa | B26D 7/015 270/52.17 |
| 6,779,790 | B2 | 8/2004 | Kitahara | |
| 6,907,806 | B1 * | 6/2005 | Okamoto et al. | 83/76.8 |
| 7,165,764 | B2 * | 1/2007 | Nakamura et al. | 270/58.11 |
| 7,201,368 | B2 * | 4/2007 | Tanigami et al. | 270/58.11 |
| 7,354,034 | B2 | 4/2008 | Nakamura et al. | |
| 7,543,806 | B2 * | 6/2009 | Nakamura et al. | 270/58.11 |
| 2001/0054342 | A1 * | 12/2001 | Kato | B26D 1/08 83/78 |
| 2004/0178565 | A1 * | 9/2004 | Reeves | 271/225 |
| 2006/0078363 | A1 * | 4/2006 | Terao et al. | 399/407 |
| 2006/0120782 | A1 * | 6/2006 | Nakamura et al. | 399/405 |
| 2007/0278732 | A1 | 12/2007 | Kitahara | |
| 2007/0279646 | A1 * | 12/2007 | Sugimoto et al. | 358/1.1 |
| 2010/0258995 | A1 | 10/2010 | Okamoto et al. | |

FOREIGN PATENT DOCUMENTS

| | | |
|---|---|---|
| JP | 2006-347678 | 12/2006 |

* cited by examiner

*Primary Examiner* — Matthew G Marini
(74) *Attorney, Agent, or Firm* — Fitzpatrick, Cella, Harper & Scinto

(57) ABSTRACT

There are provided a sheet processing apparatus which can perform a punching process while suppressing decrease in productivity, and an image forming apparatus including the sheet processing apparatus. In a third carry-in route R3 branching from a first carry-in route, a discharge roller and a buffer roller convey a sheet for which the punching process has been performed by a punching unit, so that an upstream end in a sheet conveyance direction of the sheet for which the punching process has been performed precedes an upstream end in the sheet conveyance direction of a succeeding sheet following the sheet for which the punching process has been performed.

11 Claims, 11 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and more particularly, to a sheet processing apparatus and an image forming apparatus which include a punching apparatus that performs a punching process for forming a punch hole on a sheet.

2. Description of the Related Art

Some conventional image forming apparatuses, such as duplicating machines, laser beam printers, ink-jet printers, facsimile machines and multifunction peripherals thereof, include a sheet processing apparatus which performs a binding process or a punching process for forming a punch hole, for a sheet on which an image has been formed. In such a sheet processing apparatus, for example, if the punching process is performed for the sheet, a sheet to be conveyed is caused to pass through a punch hole forming position for a punching apparatus once, and then is conveyed in the opposite direction to be returned to the punch hole forming position for the punching apparatus. Then, after the sheet is returned to the punch hole forming position in this way, the punch hole is formed at a central portion in a width direction, which is orthogonal to a sheet conveyance direction, of the sheet, by the punching apparatus (see Japanese Patent Application Laid-Open No. 2006-347678).

Incidentally, in the conventional sheet processing apparatus, and the conventional image forming apparatus including the sheet processing apparatus, there is one sheet conveyance route. Thus, if the sheet is reversed to form the punch hole, a succeeding sheet needs to wait on an upstream side in the sheet conveyance direction in the punching apparatus. Here, if the succeeding sheet is caused to wait at such a position, a waiting space, in which the succeeding sheet is caused to wait, needs to be provided on the upstream side in the sheet conveyance direction. If the waiting space is provided in this way, the size of the sheet processing apparatus is increased.

Moreover, if the waiting space is not provided, in order to secure a punching operation time for the punching apparatus, the image forming apparatus temporarily stops an image forming operation so that the succeeding sheet may not be conveyed to the sheet processing apparatus. Therefore, productivity of the image forming apparatus decreases.

Consequently, the present invention has been made in view of such a current situation, and it is an object of the present invention to provide a sheet processing apparatus which can perform the punching process while suppressing the decrease in the productivity, and an image forming apparatus including the sheet processing apparatus.

SUMMARY OF THE INVENTION

The present invention is a sheet processing apparatus which performs a punching process for a sheet, including a sheet conveyance route in which the sheet is conveyed; a branched conveyance route which branches from the sheet conveyance route; a sheet conveyance section provided on a downstream side in a conveyance direction of a branch point at which the branched conveyance route branches, in the sheet conveyance route, the sheet conveyance section being able to convey the sheet in the conveyance direction and in a direction opposite to the conveyance direction, the sheet conveyance section conveying the sheet which has passed through the branch point, in the opposite direction, and carrying the sheet into the branched conveyance route; a punching apparatus which performs the punching process for the sheet carried into the branched conveyance route; and a control section which controls the sheet conveyance section and the punching apparatus, wherein, after the control section causes the punching apparatus to perform the punching process for the sheet, the control section causes the sheet conveyance section to convey the sheet for which the punching process has been performed, in the conveyance direction, so that an upstream end in the sheet conveyance direction of the sheet for which the punching process has been performed precedes an upstream end in the sheet conveyance direction of a succeeding sheet following the sheet for which the punching process has been performed.

As in the present invention, the sheet for which the punching process has been performed is conveyed so that a downstream end in the sheet conveyance direction of the sheet for which the punching process has been performed precedes a downstream end in the sheet conveyance direction of a succeeding sheet following the sheet for which the punching process has been performed. Thereby, the punching process can be performed while decrease in productivity is suppressed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
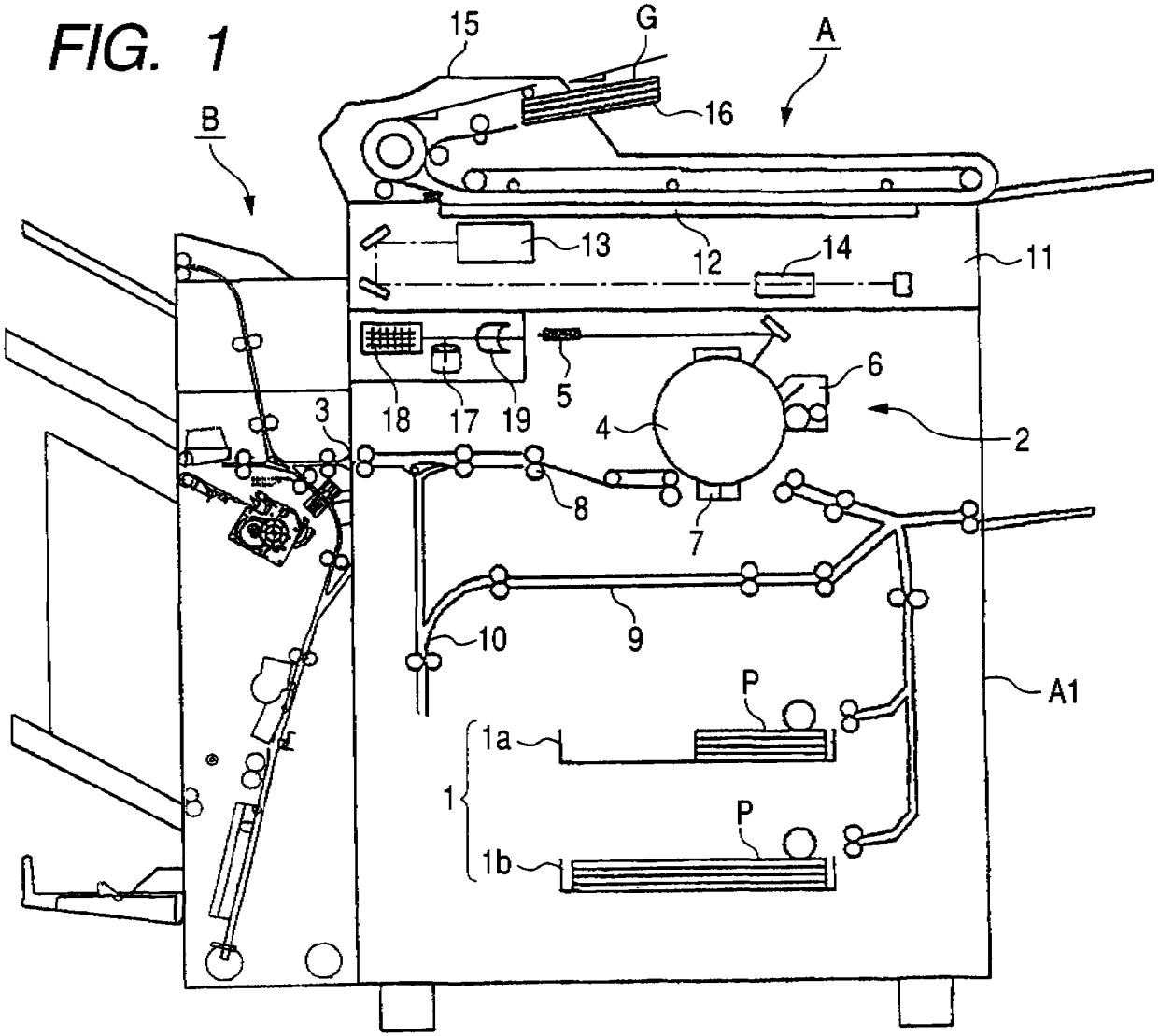
FIG. 1 is an overall configuration diagram of an image forming apparatus including a sheet processing apparatus according to an embodiment of the present invention.

Next, an embodiment of the present invention will be described with reference to the drawings. FIG. 1 is an overall configuration diagram of an image forming apparatus including a sheet processing apparatus according to an embodiment of the present invention. FIG. 1 illustrates an image forming apparatus A and an image forming apparatus main body A1.

A sheet processing apparatus B is connected to a side of the image forming apparatus main body A1. An image reading apparatus 11 is provided on an upper surface of the image forming apparatus main body A1.

Here, the image forming apparatus main body A1 includes an image forming section 2 and a paper feeding section 1. The image forming apparatus main body A1 is adapted to send a sheet from the paper feeding section 1 to the image forming section 2, perform printing on the sheet in the image forming section 2, and then discharge the sheet via a paper discharge outlet 3. It should be noted that, from sheets P of a plurality of sizes stored in paper feeding cassettes 1*a* and 1*b*, the paper feeding section 1 separates and feeds each designated one of the sheets P to the image forming section 2. Moreover, the image forming section 2 includes, for example, a photosensitive drum 4, a print head (laser light emitter) 5 arranged around the photosensitive drum 4, a developing device 6, a transfer charger 7 and a fixing device 8.

The image reading apparatus 11 scans a document set on a platen 12 by a scan unit 13, and electrically reads the document by a photoelectric conversion element (not illustrated). The image reading apparatus 11 includes a feeder apparatus 15 which feeds a document G received on a loading tray 16 to the platen 12. In addition, if a document image is read, the feeder apparatus 15 conveys the document G to the platen 12, and then, the scanning is performed by the scan unit 13 so as to read the document image. It should be noted that, for example, digital processing is performed for read image data in an image processing section, then the read image data is transferred to a data storage section 14, and an image signal is transmitted to the laser light emitter 5.

Then, in the image forming apparatus main body A1, depending on a received image signal, the laser light emitter 5 emits laser light depending on the image signal, onto the photosensitive drum so as to form an electrostatic latent image on the photosensitive drum. This electrostatic latent image is developed with toner by the developing device 6 so as to form a toner image. Subsequently, the toner image is transferred onto the sheet by the transfer charger 7, and heating fixing is performed for the sheet P on which the toner image has been transferred, by the fixing device 8. Thereby, the toner image is fixed on the sheet. The sheets P on which the toner image has been fixed in this way are sequentially carried out via the paper discharge outlet 3 to the sheet processing apparatus B.

It should be noted that, in FIG. 1, a circulation route 9 is a route for double sided printing in which, when images are formed on both sides of the sheet, the printing is performed on a front side of the sheet P by the fixing device 8, two sides of the sheet P are reversed via a switchback route 10, then the sheet P is fed to the image forming section 2 again, and the printing is performed on a reverse side of the sheet P. Then, the sheet P, which has been fed through this circulation route 9 to the image forming section 2, and on which the double sided printing has been performed, is subsequently carried out via the paper discharge outlet 3 to the sheet processing apparatus B.

The sheet processing apparatus B takes in the sheets P carried out from the image forming apparatus main body A1, in order. Then, the sheet processing apparatus B performs a process for aligning and tying up a plurality of the sheets P which have been taken in, in a bundle, and a punching process for punching near back ends of the sheets P which have been taken in. Moreover, the sheet processing apparatus B performs processes such as a staple process (binding process) for stapling a back end side of the bundle of the sheets, and a bookbinding process.

Figure 2:
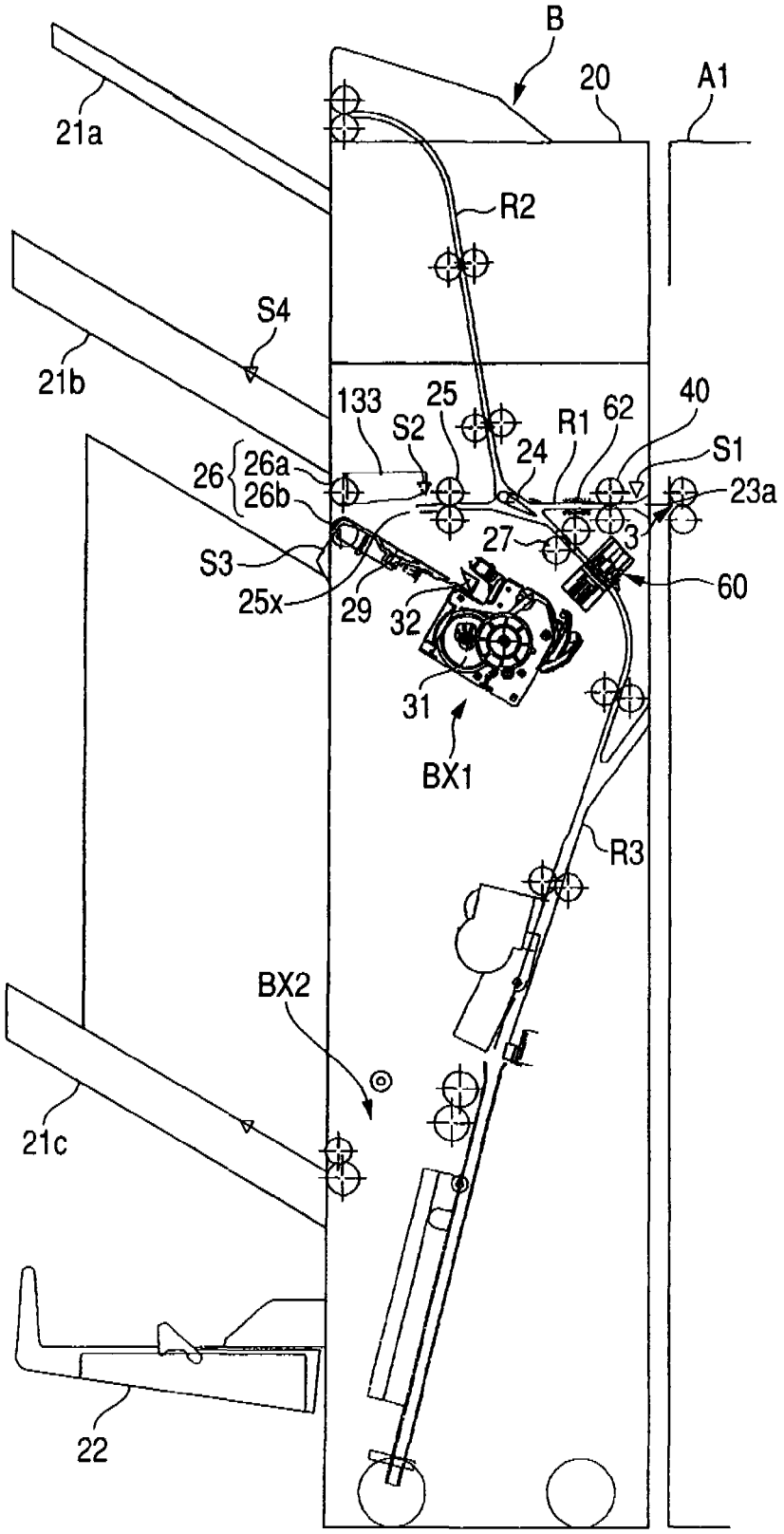
FIG. 2 is an overall configuration diagram of the sheet processing apparatus.

It should be noted that, in the present embodiment, as illustrated in FIG. 2, a carry inlet 23*a* of the sheet processing apparatus B is coupled to the paper discharge outlet 3 of the image forming apparatus main body A1. In addition, depending on a mode which is set, after the image forming performed in the image forming apparatus main body A1, the sheet processing apparatus B is adapted to directly receive the conveyed sheets on a sample tray 21*a*, or to perform one of the punching process and a staple-binding process for the conveyed sheets and store the sheets on one of loading trays 21*b* and 21*c*. Moreover, if a bookbinding mode is set, the sheet processing apparatus B is adapted to align the sheets in a bundle form for each copy, perform the staple process on the center of the bundle, then applies the bookbinding process for folding the bundle in a brochure form, and store the bundle in the brochure form on a saddle tray 22.

Within a casing (outer cover) 20 of the sheet processing apparatus B, there are provided a first processing section BX1 which aligns and accumulates the sheets from the carry inlet 23*a* for each copy, and performs binding finishing for the sheets, on a processing tray 29, and a second processing section BX2 which aligns and accumulates the sheets for each copy, and performs brochure finishing for the sheets. A first carry-in route R1 is provided between the first processing section BX1 and the carry inlet 23*a*. In addition, in this first carry-in route R1 which is a sheet conveyance route, a second carry-in route R2 is provided which branches from the first carry-in route R1 so as to receive the conveyed sheets on the sample tray 21*a*. Moreover, in this first carry-in route R1, a third carry-in route R3 is provided which is a branched conveyance route that branches from the first carry-in route R1 so as to convey the conveyed sheets to the second processing section BX2. It should be noted that a route switching member 24 sorts the sheets from the carry inlet 23*a*, into any one of the first processing section BX1, the second carry-in route R2 and the third carry-in route R3, depending on the mode which is set.

This third carry-in route R3 is for carrying the sheets into the second processing section BX2 when the brochure finishing is performed. In addition, this third carry-in route R3 is also included in a waiting section in which a succeeding sheet that has been sent to the sheet carry inlet 23*a* is caused to temporarily stay, during a process operation in which the process such as the staple-binding is applied to the bundle of sheets. It should be noted that, as will be described later, when a punch hole is formed on the sheet, the sheet is carried into this third carry-in route R3.

In addition, when an end-binding process is applied to the bundle of sheets which have been aligned and accumulated for each copy on the processing tray 29, the succeeding sheet from the first carry-in route R1 is switched back by a discharge roller 25 and a buffer roller 27, and is caused to stay in this third carry-in route R3. It should be noted that, after the succeeding sheet is caused to temporarily stay, when processed sheets on the processing tray 29 are carried out, a plurality of the succeeding sheets within the third carry-in route is caused to overlap and is simultaneously conveyed to the processing tray 29 by the buffer roller 27 and the discharge roller 25. It should be noted that this buffer roller 27 and the discharge roller 25 are included in a forward/reverse rotatable sheet conveyance section which conveys the sheet that has passed through a branch point BR, in the opposite direction, so as to carry the sheet into the third carry-in route R3, at a time of a punch hole forming operation to be described later.

Moreover, a paper discharge sensor S2 is arranged at a paper discharge outlet 25*x* of the first carry-in route R1. This paper discharge sensor S2 detects the sheet passing through the first carry-in route R1 so as to perform jam detection. In addition, at a downstream side of this paper discharge outlet 25*x*, a vertical difference in level is formed to arrange the processing tray 29. It should be noted that, in the first processing section BX1, there are provided the processing tray 29, and an end-binding staple unit 31 which is a binding apparatus arranged on an upstream side in a sheet discharge direction of this processing tray 29.

Moreover, the processing tray 29 is tilted so that the upstream side in the sheet discharge direction becomes lower. Furthermore, at an upstream end, which is on the upstream side in the sheet discharge direction, of the processing tray 29, a sheet end regulation member 32 is provided which contacts with the back end, which is an upstream side end in the sheet discharge direction, of the discharged sheet, so as to regulate a position of the sheet in the sheet discharge direction. The sheet is discharged via the paper discharge outlet 25*x*, and the back end of the sheet is caused to hit this sheet end regulation member 32 by a pair of switchback rollers 26 to be described later, and the tilt of the processing tray 29. Thereby, the sheet is positioned at a binding position, which is a process position that has been previously set, in order to perform the binding process.

On the other hand, the pair of switchback rollers conveys the sheet discharged onto (carried into) the processing tray 29, to the sheet end regulation member 32. Here, this pair of switchback rollers 26 is forward/reverse rotatable so that this pair of switchback rollers 26 conveys the sheet discharged onto the processing tray 29, in the discharge direction, and then conveys the sheet in a direction opposite to the discharge direction so as to direct the sheet to the sheet end regulation member 32. Moreover, this pair of switchback rollers 26 includes a fixed roller 26*b* provided at a downstream side end portion of the processing tray 29, and a movable roller 26*a* provided at a swinging guide 133 that is swingably provided over the processing tray 29. In addition, the movable roller 26*a* can connect and disconnect to the fixed roller 26*b* along with swings of the swinging guide 133.

According to such a configuration, the sheet P discharged from the discharge roller 25 slides down on one of a loading surface of the processing tray 29 and the sheet loaded on the processing tray 29, due to the pair of switchback rollers 26 and the tilt of the processing tray 29. Thereby, the back end (an upstream end in the discharge direction) of the sheet P is caused to hit the sheet end regulation member 32. Moreover, at the processing tray 29, a side alignment unit (not illustrated) is arranged which pushes and aligns the width of the sheet. For this side alignment unit, any one of center reference for positioning the sheet carried into the processing tray 29 from the paper discharge outlet 25*x*, with reference to the center of the sheet, and side reference for positioning the sheet with reference to a left or right side edge of the sheet, is employed. In addition, after a width direction of the sheet is positioned by this side alignment unit, depending on a mode selected by a user, for example, the end-binding staple unit 31 performs the binding process, and subsequently, the sheets are loaded on one of the loading trays 21*b* and 21*c*, by the pair of switchback rollers 26.

It should be noted that, in FIG. 2, an inlet sensor S1 senses the sheet discharged from the image forming apparatus main body A1, and counts the number of sheets passing through. A paper side sensing sensor S3 senses an upper side of the sheet loaded on the loading tray. A loading tray-paper presence/absence sensor S4 senses presence/absence of the sheet on the loading tray. Moreover, an inlet roller 40 conveys the sheet carried out from the image forming apparatus main body A1.

Figure 3:
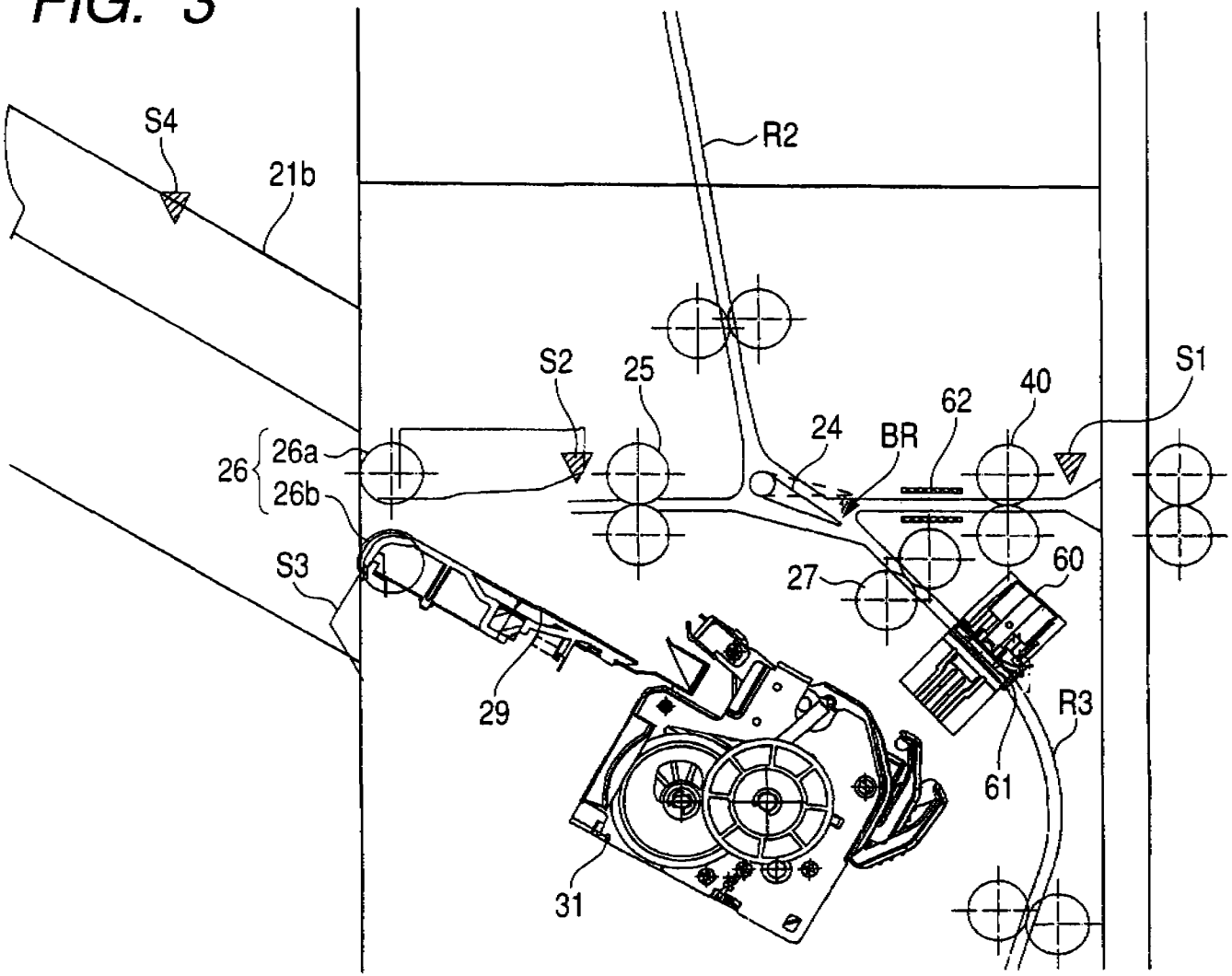
FIG. 3 is an enlarged diagram of a main section of the sheet processing apparatus.

Incidentally, as illustrated in FIG. 3, in the third carry-in route R3, a punching unit 60 is provided as a punching apparatus which forms a punch hole (punches) on each one of the sheets P. It should be noted that this punching unit 60 can move in the width direction which is orthogonal to a sheet conveyance direction, depending on a side end position of the conveyed sheet. Thereby, even if the sheet is shifted in the width direction, the punch hole can be formed on a central portion of the sheet. It should be noted that, in this punching unit 60, on the side of the second processing section BX2, a stopper 61 is provided so that the stopper 61 can freely appear and disappear in the third carry-in route R3. In addition, at a time of a sheet buffering process to be described later, this stopper 61 is caused to project into the third carry-in route R3 so as to be able to cause the sheet to wait within the third carry-in route R3, without directing the sheet to the second processing section BX2. Moreover, at a time of a punch hole forming process, this stopper 61 is caused to project into the third carry-in route R3 to lock the sheet so as to be able to retain the sheet at a punch hole forming position for the punching unit 60.

Moreover, a lateral registration unit 62 which senses the side end position in the width direction of the sheet is provided on an upstream side in the sheet conveyance direction of the branch point BR which branches into the third carry-in route R3, in the first carry-in route R1. In addition, if the punch hole is formed on the sheet, a lateral shift, which is a shift of the sheet in the width direction, is sensed by the lateral registration unit 62, and then, the buffer roller 27 and the discharge roller 25, which are forward/reverse rotatable, are reversed, as well as the route switching member 24 is switched, so as to carry the sheet into the third carry-in route R3.

Figure 4A:
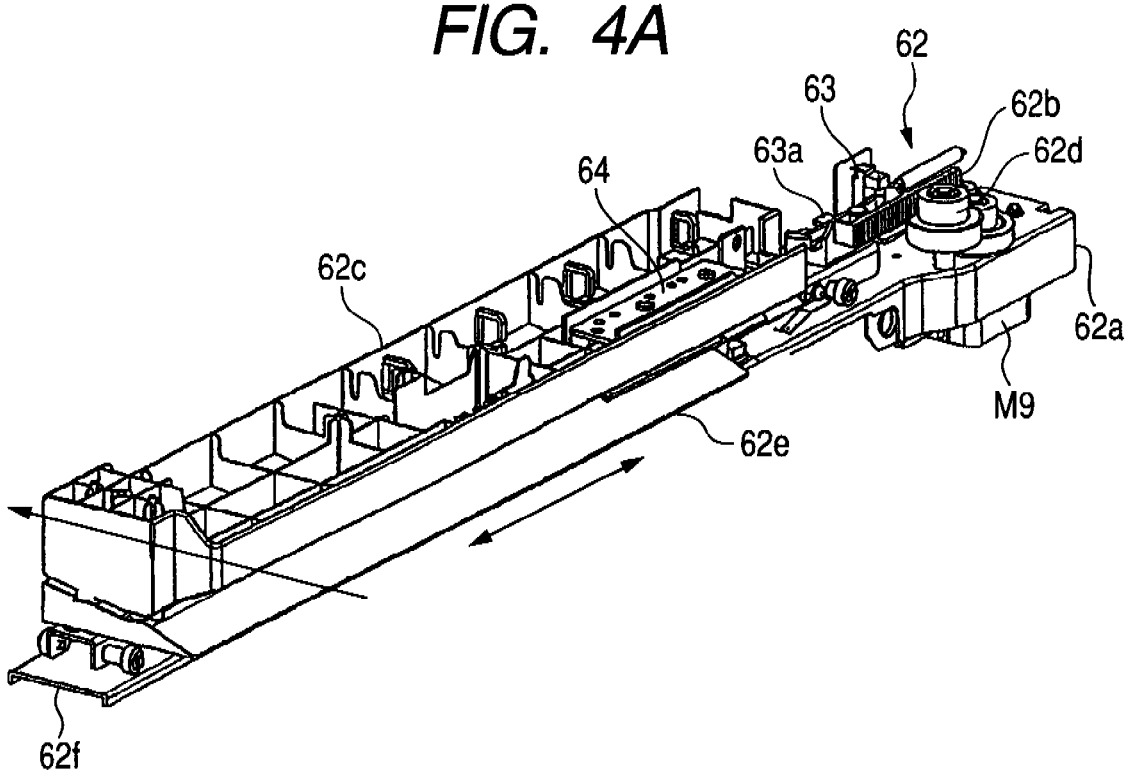
FIGS. 4A and 4B are first diagrams describing a configuration of a lateral registration unit provided in the sheet processing apparatus.
Figure 4B:
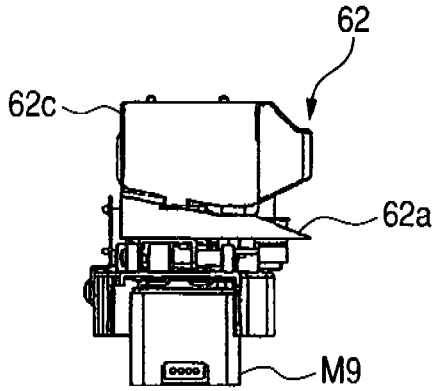
Figure 5:
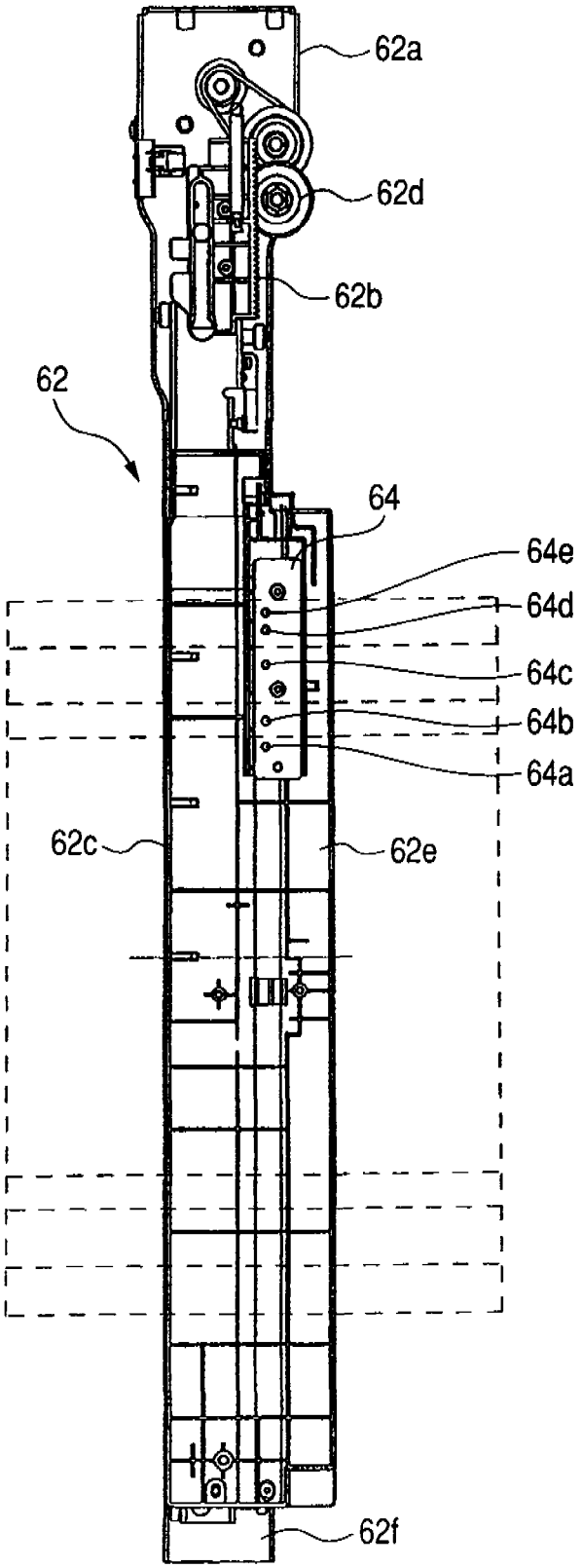
FIG. 5 is a second diagram describing the configuration of the lateral registration unit.

Here, as illustrated in FIGS. 4A, 4B and 5, the lateral registration unit 62 has a unit main body 62*a* and a rack section 62*b*, and includes a sliding section 62*c* which is provided so as to be slidable in the width direction in the unit main body 62*a*. Moreover, the lateral registration unit 62 includes, for example, a lateral registration motor M9 which rotates a pinion gear 62*d* that engages with the rack section 62*b*, as a moving unit which slides the sliding section 62*c*. In addition, if a shift amount of a position in the width direction of the sheet which has been conveyed with reference to the center of the sheet is sensed, the lateral registration motor M9 is rotated so as to slide the sliding section 62*c* in the width direction as illustrated by an arrow in FIG. 4A. Moreover, after the punch hole forming operation is completed, the lateral registration motor M9 which moves the sliding section 62*c* is reversed so as to return the sliding section 62*c* to a home position.

It should be noted that when the sliding section 62*c* returns to the home position, a lateral registration home position (HP) sensor 63 is shaded by a flag 63*a* which is provided at the rack section 62*b*, so as to sense that the sliding section 62*c* has returned to the home position.

On the other hand, a lateral registration sensor unit 64 is a sensing section which is provided in the sliding section 62*c* and senses the side end position in the width direction of the sheet. This lateral registration sensor unit 64 includes a plurality of (five in the present embodiment) transmission sensors, that is, first to fifth lateral registration sensors 64*a* to 64*e*, which are provided side by side in the width direction. Here, the first lateral registration sensor 64*a* is for sensing a leading end of the sheet, and the second to fifth lateral registration sensors 64*b* to 64*e* are for sensing a side end of the sheet.

As this side end sensing unit, for example, the second to fifth lateral registration sensors 64*b* to 64*e* are arranged at positions where the second to fifth lateral registration sensors 64*b* to 64*e* can sense the side end of the sheet P, depending on the size (one of B5, B5R, A4 and A4R) of the sheet P discharged from the image forming apparatus main body A1. It should be noted that a conveyance guide 62*e* guides the sheet to a position below the lateral registration sensor unit 64, and a base frame 62*f* slidably supports the sliding section 62*c*.

If the lateral registration unit 62 as described above senses the side end position of the sheet, for example, if the lateral registration unit 62 senses the side end position of the sheet of B5 size, first, when the first lateral registration sensor 64*a* senses the leading end of the sheet, the sliding section 62*c* is slid from the home position into the width direction. Then, subsequently, the sliding section 62*c* is slid until the second lateral registration sensor 64*b* senses the side end position of the sheet.

Here, sensing signals related to the side end position of the sheet, from these respective lateral registration sensors 64*a* to 64*e*, are input to, for example, a CPU 90, which is a control unit illustrated in FIG. 6 to be described later. When the sensing signal from the second lateral registration sensor 64*b* is input, the CPU 90 calculates a position shift of the sheet in the width direction, based on an amount of movement of the sliding section 62*c* until then. Furthermore, the CPU 90 moves the punching unit 60 in the width direction to a position where the punch hole can be formed in the center of the sheet, based on a result of the calculation, and then performs the punch hole forming operation.

In addition, since the punching unit 60 is moved in the width direction based on the shift amount of the sheet P in this way, even if the sheet P is conveyed in a state where the sheet P is shifted, the punch hole can be formed at an appropriate position. In other words, in the present embodiment, after a lateral shift amount is sensed by the lateral registration unit 62, the punching unit 60 is previously moved to the punch hole forming position. Thereby, a time for starting the punch hole forming operation can be shortened, in comparison with a case where the lateral shift amount is sensed after the sheet reaches the punching unit, and subsequently, the punching unit is moved to the punch hole forming position.

Figure 6:
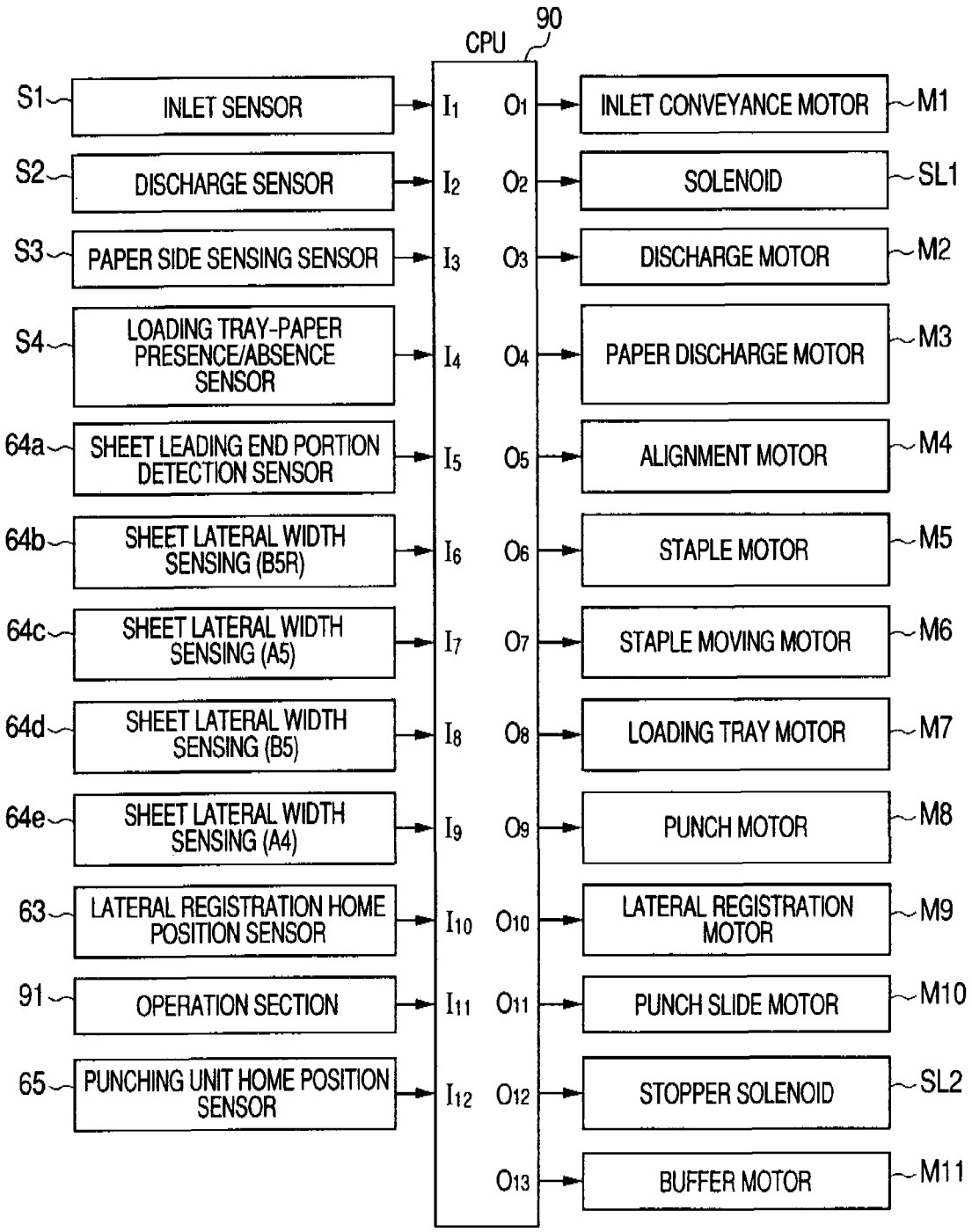
FIG. 6 is a control block diagram of the image forming apparatus.

FIG. 6 is a control block diagram of the image forming apparatus A. The CPU 90 includes a ROM (not illustrated) in which control programs corresponding to flowcharts illustrated in FIGS. 7 and 9 to be described later are stored, and a RAM (not illustrated) which is used as an area in which control data is temporarily retained, and as a work area for calculation associated with control. Here, the inlet sensor S1, the discharge sensor S2, the paper side sensing sensor S3, the loading tray-paper presence/absence sensor S4, the first to fifth lateral registration sensors 64*a* to 64*e*, the lateral registration home position sensor 63, a punching unit home position sensor 65 and an operation section 91 are connected to the CPU 90.

It should be noted that the operation section 91 sets image forming conditions, for example, printing conditions such as designation of the sheet size, designation of the number of copies to be printed, designation of single sided/double sided printing, and designation of enlarged/reduced printing. Moreover, simultaneously with the image forming conditions, the operation section 91 sets process conditions such as a punch hole forming mode, a printout mode, an offset mode, a binding finishing mode and a brochure finishing mode.

Moreover, an inlet conveyance motor M1 which drives the inlet roller 40, a solenoid SL1 which actuates the route switching member 24, and a forward/reverse rotatable discharge motor M2 which drives the discharge roller 25 are connected to the CPU 90. Furthermore, a forward/reverse rotatable paper discharge motor M3 which drives the pair of switchback rollers 26, a forward/reverse rotatable alignment motor M4 which drives the side alignment unit, and a forward/reverse rotatable staple motor M5 which drives the end-binding staple unit 31 are connected. Moreover, a staple moving motor M6 which moves the end-binding staple unit 31 in the width direction, a forward/reverse rotatable loading tray motor M7 which moves the loading tray up and down, and a punch motor M8 which drives the punching unit 60 to form the punch hole are connected. Furthermore, the forward/reverse rotatable lateral registration motor M9 which moves the lateral registration unit 62 in the width direction, and a forward/reverse rotatable punch slide motor M10 which is included in a moving section that slides the punching unit in the width direction are connected. Moreover, a stopper solenoid SL2 which actuates the stopper 61, and a forward/reverse rotatable buffer motor M11 which drives the buffer roller 27 are connected.

In addition, the CPU 90 controls driving of each motor and the like according to sensor input, the control programs stored in the ROM, and setting in the operation section 91. It should be noted that, in the present embodiment, while the CPU 90 is provided in the image forming apparatus main body A1, the CPU 90 may be mounted in the sheet processing apparatus B. Moreover, if the CPU is provided in the sheet processing apparatus B, the sheet processing apparatus B may be controlled by the CPU 90 provided in the image forming apparatus main body A1, via the CPU on the sheet processing apparatus side.

Incidentally, when the punch hole is formed on the sheet, if there is one sheet conveyance route as described above, the succeeding sheet needs to wait at a waiting position, or the image forming on the succeeding sheet needs to be temporarily stopped. However, if the succeeding sheet is caused to wait in this way, a waiting space, in which the succeeding sheet is caused to wait, needs to be provided on the upstream side in the sheet conveyance direction of the punching unit 60. If the waiting space is provided in this way, the size of the sheet processing apparatus B is increased. Moreover, if the image forming apparatus A temporarily stops an image forming operation, productivity of the image forming apparatus A decreases.

Consequently, in the present embodiment, the punching unit 60 is provided in the third carry-in route R3 so that, when the punch hole is formed on the sheet, the punch hole is formed on the sheet in the third carry-in route R3. According to such a configuration, as will be described later, the sheets can be partially overlapped, and the punch hole can be continuously formed without stopping the succeeding sheet. Alternatively, even if the sheet is caused to wait, the sheet can be caused to wait at a position near a reverse portion side. As a result, the waiting space can be narrowed, and the increase in the size of the sheet processing apparatus B can be prevented.

Figure 7:
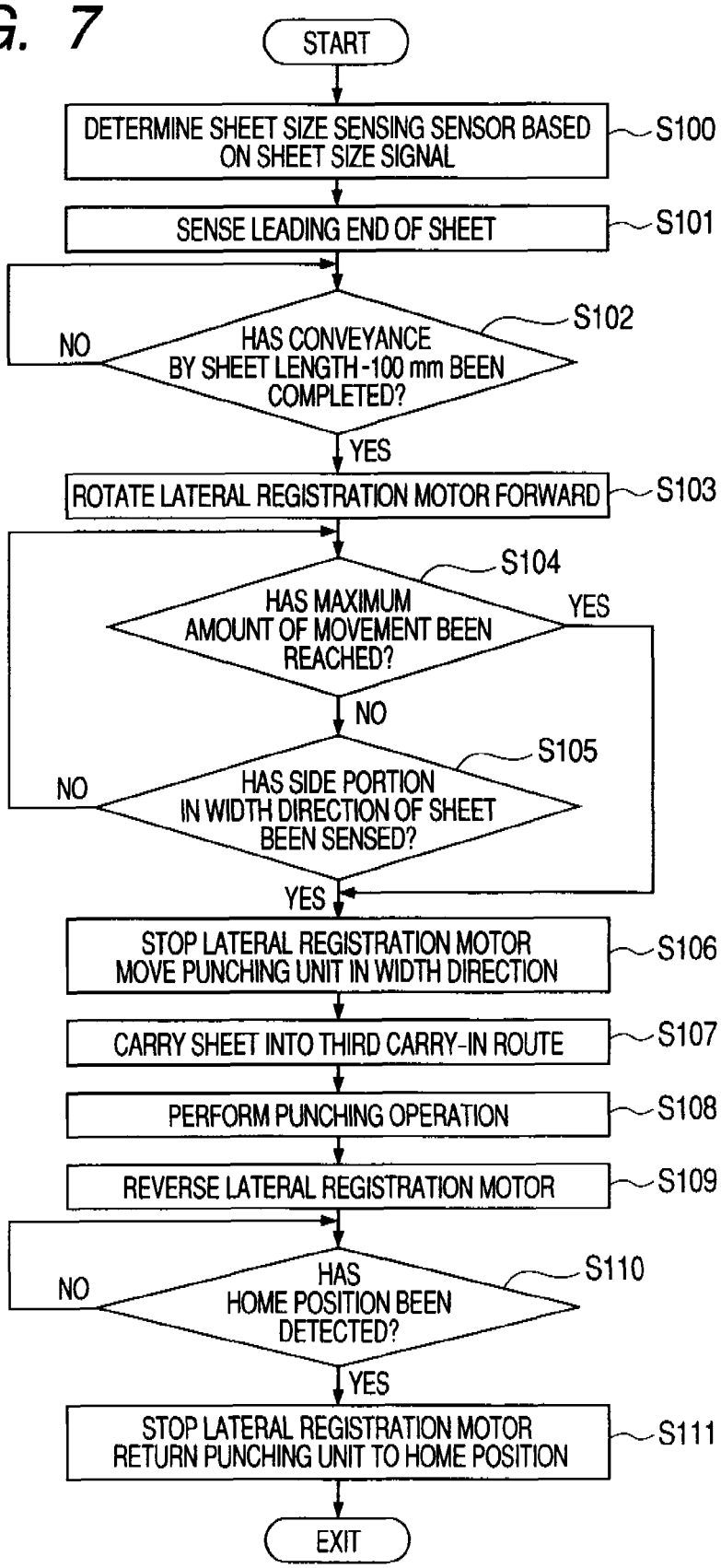
FIG. 7 is a flowchart illustrating control of a punch hole forming operation in the sheet processing apparatus.

Next, control of a punch forming operation by the CPU 90 according to the present embodiment will be described by using the flowchart illustrated in FIG. 7. First, based on a sheet size signal from the operation section 91, the CPU 90 determines a sheet size sensing sensor which senses the side end position of the sheet (S100). For example, if the size of the sheet is B5 size, the second lateral registration sensor 64*b* is determined as the sheet size sensing sensor. Next, after the sheet is carried in from the image forming apparatus main body A1, the CPU 90 waits until the leading end of the sheet conveyed by the inlet roller 40 is sensed by a sheet leading end sensing sensor 64*a* (S101). Subsequently, when the sheet leading end sensing sensor 64*a* senses the leading end of the sheet, the CPU 90 conveys the sheet by a predetermined distance, for example, a sheet length (a length of the sheet in the sheet conveyance direction)—100 mm (S102). Then, when such conveyance of the sheet is completed (Y in S102), the lateral registration motor M9 is rotated forward (S103), and the sliding section 62*c* of the lateral registration unit 62 is moved in the width direction.

Thereby, the second lateral registration sensor 64*b* gradually approaches the side end of the sheet. Then, before the sliding section 62*c* reaches a maximum amount of movement, when the second lateral registration sensor 64*b* senses a side portion in the width direction of the sheet (N in S104, Y in S105), the lateral registration motor M9 is stopped (S106). It should be noted that when the side portion of the sheet is sensed, the sensing signal from the second lateral registration sensor 64*b* is input to the CPU 90. Then, based on this sensing signal and an amount of slide movement of the sliding section 62*c*, the CPU 90 calculates the lateral shift amount of the sheet, drives the punch slide motor M10 depending on a result of this calculation, and moves the punching unit 60 to the central portion in the width direction (S106). It should be noted that the sheet processing apparatus B includes the punching unit home position sensor 65, and the punching unit home position sensor 65 senses a home position of the punching unit 60 moving in the width direction. The calculation result provided by the CPU 90 is an amount of the movement of the punching unit 60 from the home position. Thereby, if the sheet is shifted, the punching unit 60 can be moved to an appropriate position where the punch hole can be formed at the central portion in the width direction of the sheet, before the sheet reaches the punching unit 60.

Figure 8A:
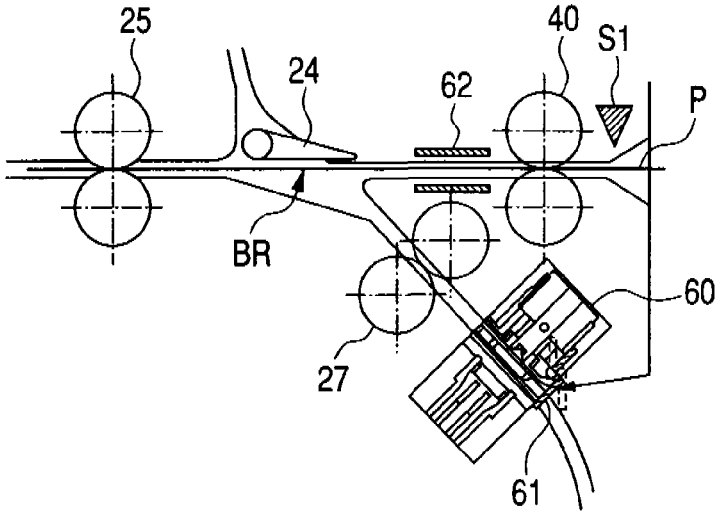
FIGS. 8A, 8B and 8C are diagrams describing motions of a sheet at a time of the punch hole forming operation.
Figure 8B:
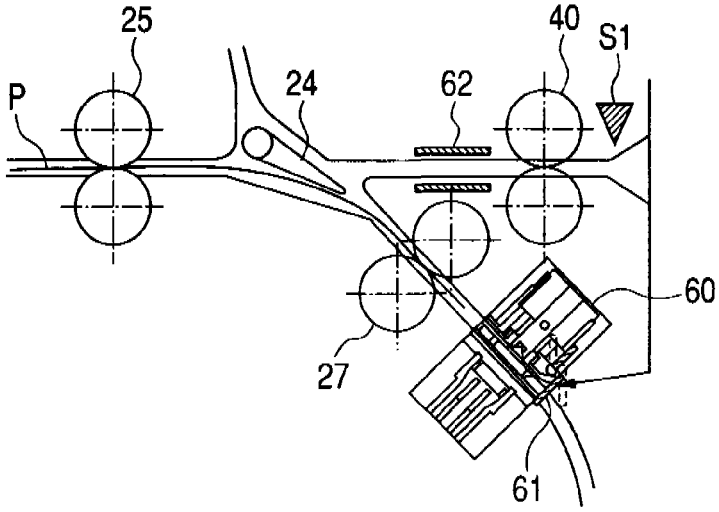
Figure 8C:
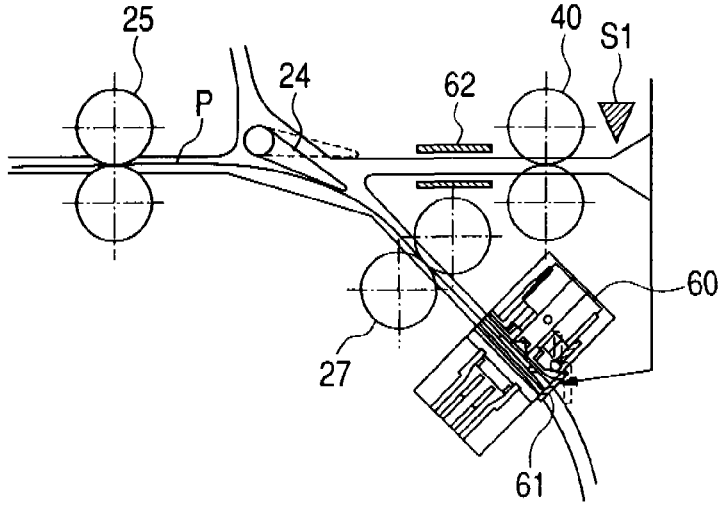

It should be noted that when the sheet P reaches the discharge roller 25 as illustrated in FIG. 8A, and subsequently, the back end of the sheet passes through the branch point BR, the CPU 90 reverses the discharge roller and the buffer roller 27, and also turns the route switching member 24 downward as illustrated in FIG. 8B. Thereby, the sheet P is carried into the third carry-in route R3. It should be noted that, at this time, the CPU 90 causes the stopper 61 to project into the third carry-in route R3, and causes the back end of the sheet P carried into the third carry-in route R3 to contact with this stopper 61 so as to enable the sheet P to be stopped at the punch hole forming position as illustrated in FIG. 8C. Moreover, since the back end of the sheet P contacts with the stopper 61 in this way, skew of the sheet P is corrected.

Next, after the sheet P is carried into the third carry-in route R3 (S107), and is caused to contact with the stopper 61 in this way, the CPU 90 performs the punching process by the punching unit 60 (S108). Here, at this time, as described above, before the sheet reaches the punching unit 60, the punching unit 60 has moved to the appropriate position where the punch hole can be formed at the central portion in the width direction of the sheet. Therefore, the punch hole forming operation can be immediately started.

On the other hand, when the sheet P is carried into the third carry-in route R3, the CPU 90 reverses the lateral registration motor M9 (S109) so as to move the lateral registration unit 62 in a direction of the home position. Then, subsequently, if the lateral registration home position sensor 63 is shaded by the flag 63*a* provided at the rack section 62*b*, so as to sense that the sliding section 62*c* has reached the home position (Y in S110), the lateral registration motor M9 is stopped (S111). Thereby, the sliding section 62*c* returns to the home position, and prepares to sense the side end position of the next succeeding sheet. Then, the punching unit 60, which has completed the punching process, is driven to move by the punch slide motor M10. When the home position of the punching unit 60 is sensed by the punching unit home position sensor 65, the punching unit 60 stops (S111).

Figure 9:
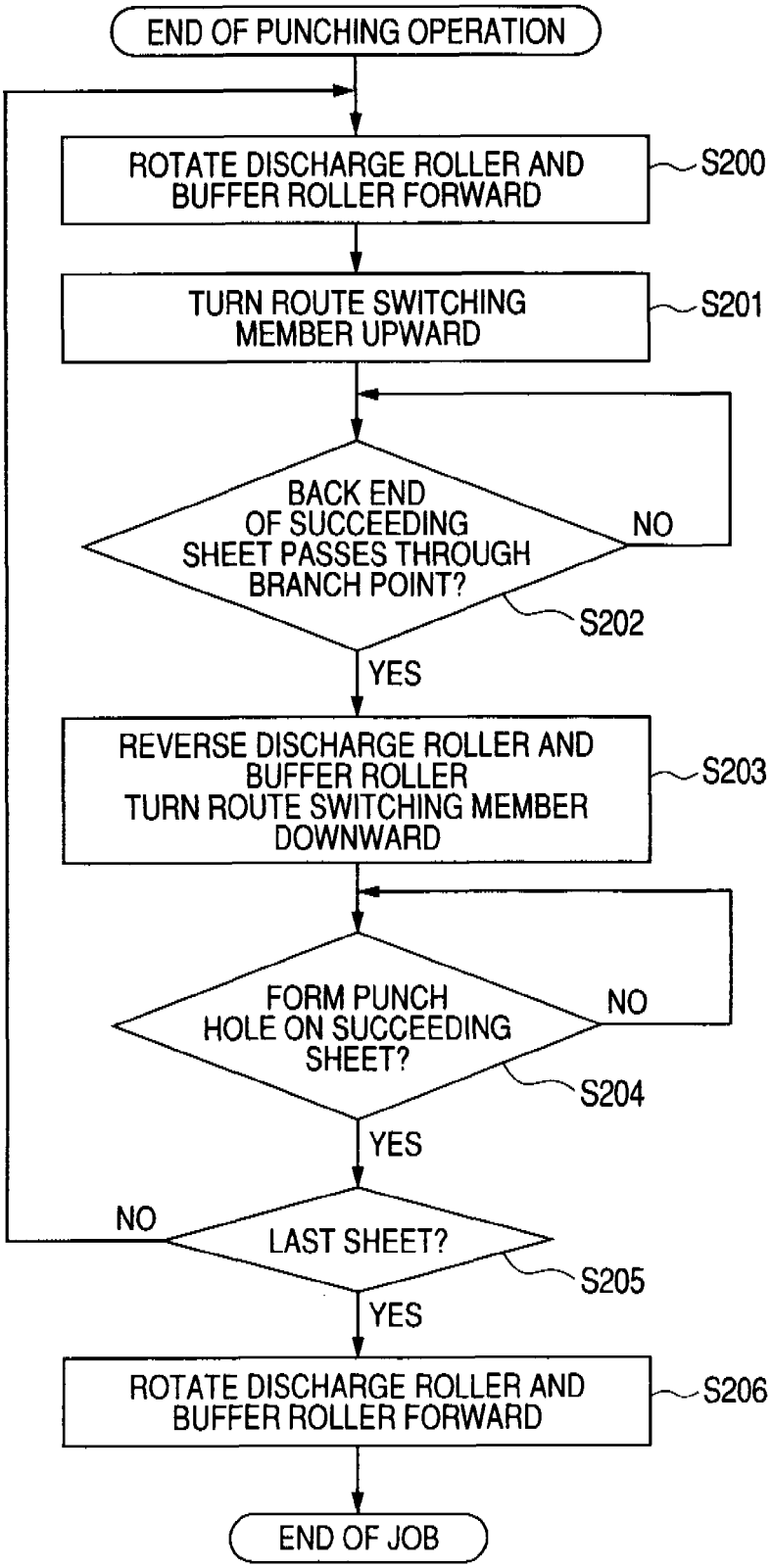
FIG. 9 is a flowchart illustrating control when a punch hole is formed on a succeeding sheet in the sheet processing apparatus.
Figure 10A:
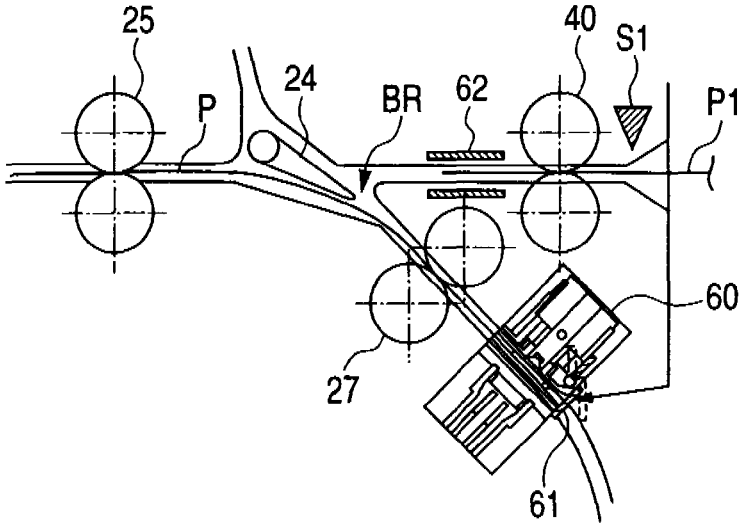
FIGS. 10A, 10B and 10C are first diagrams describing the motions of the sheet when the punch hole is formed on the succeeding sheet.

Incidentally, FIG. 9 is a flowchart illustrating the control when the punch hole is formed on the succeeding sheet after the punch hole has been formed on the sheet in this way. Here, after the punch hole is formed at a back end portion of the sheet by the punching unit 60, the CPU 90 rotates the discharge roller 25 and the buffer roller 27 forward (S200), and conveys the sheet on which the punch hole has been formed, toward the processing tray 29. Furthermore, the route switching member 24 is turned upward (S201). It should be noted that when the sheet P is conveyed to the processing tray 29 in this way, the succeeding sheet P1 does not stop and is conveyed by the inlet roller 40 at a timing when the succeeding sheet P1 reaches a position before the branch point BR as illustrated in FIG. 10A.

Figure 10B:
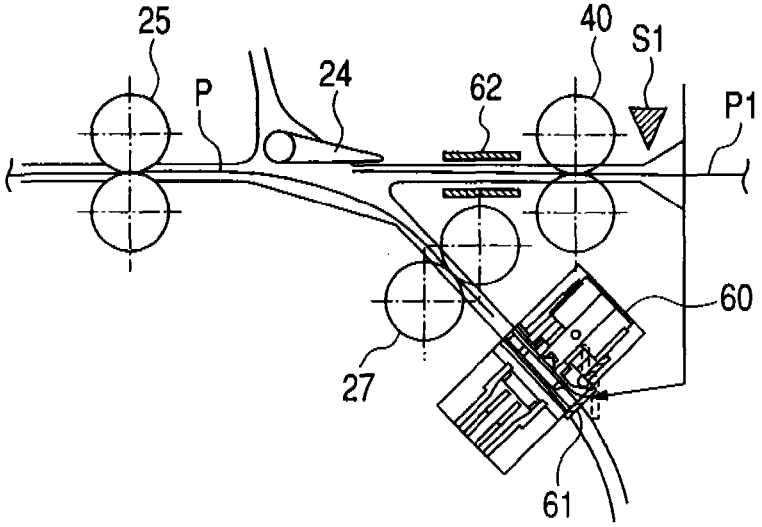
Figure 10C:
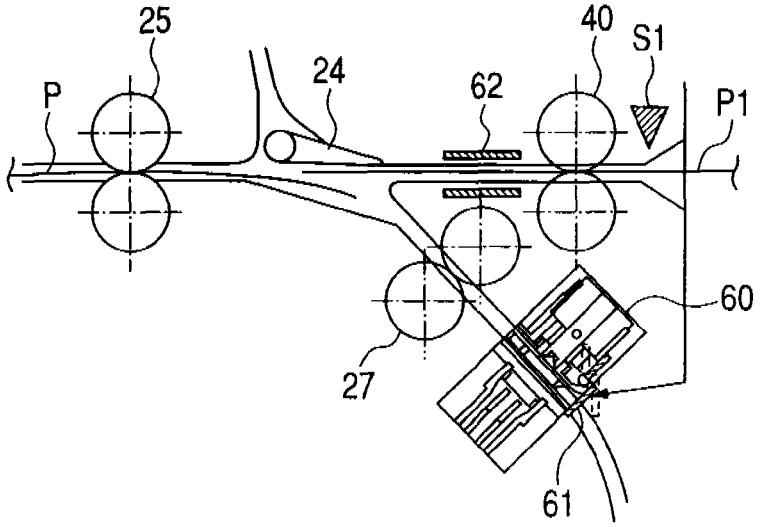
Figure 11A:
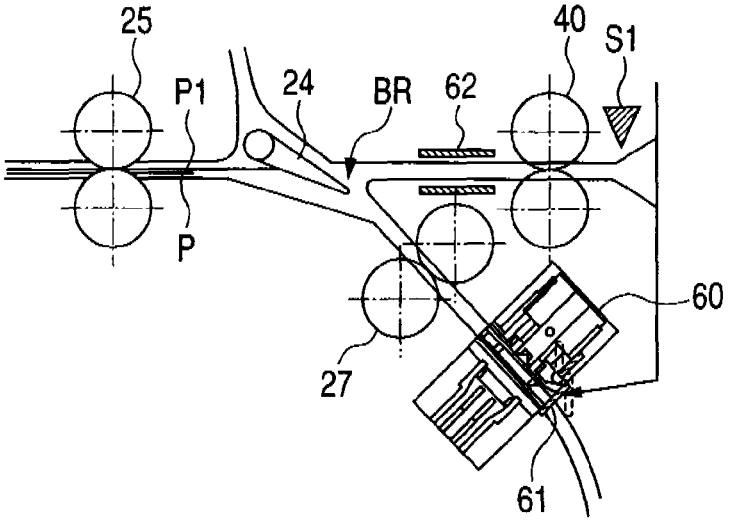
FIGS. 11A, 11B and 11C are second diagrams describing the motions of the sheet when the punch hole is formed on the succeeding sheet.

Thereby, when a preceding sheet P is conveyed by the forward rotation of the discharge roller 25 and the buffer roller 27, the succeeding sheet P1 is continuously conveyed by the inlet roller 40 which is an upstream sheet conveyance section, and reaches the branch point BR as illustrated in FIG. 10B. As a result, subsequently, a leading end portion of the succeeding sheet P1 is conveyed in a state where the leading end portion of the succeeding sheet P1 partially overlaps the back end portion of the preceding sheet P, along with the sheet P, toward the processing tray 29, as illustrated in FIG. 10C. In other words, the back end, which is an upstream end in the sheet conveyance direction, of the preceding sheet P is conveyed in a state where the back end of the preceding sheet P precedes the back end, which is the upstream end in the sheet conveyance direction, of the succeeding sheet P1. In other words, as a result, even after the preceding sheet P is discharged on the processing tray 29, the succeeding sheet P1 is in a state where the succeeding sheet P1 can be conveyed by the discharge roller 25. Subsequently, when the back end of the succeeding sheet P1 passes through the branch point BR (Y in S202), the CPU 90 reverses the discharge roller 25 and the buffer roller 27, and also turns the route switching member 24 downward as illustrated in FIG. 11A (S203). Thereby, the succeeding sheet P1 is carried into the third carry-in route R3. It should be noted that the CPU 90 determines that the back end of the succeeding sheet passes through the branch point BR in this way, for example, according to a sheet sensing signal from the inlet sensor S1.

Here, when the succeeding sheet P1 is conveyed to the position before the branch point BR, and the sheet P is conveyed toward the processing tray 29 in this way, the succeeding sheet P1 and the sheet P are conveyed in the state where the succeeding sheet P1 partially overlaps the sheet P. Therefore, a timing when the back end of the succeeding sheet P1 passes through the branch point BR can be advanced. As a result, the productivity at a time of the punching process can be improved. Moreover, a timing when the punching process for the succeeding sheet P1 is started can be advanced.

Figure 11B:
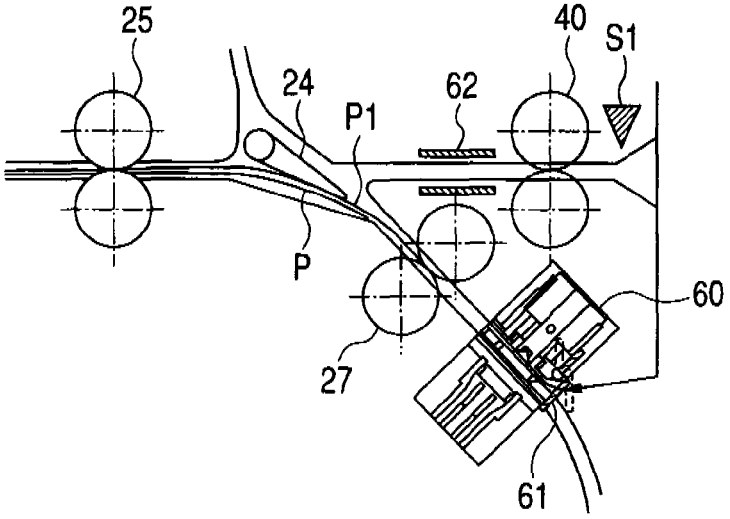

It should be noted that the sheet processing apparatus B of the present invention can also simultaneously carry two sheets, that is, the sheet P on which the punch hole has been formed and the succeeding sheet P1, into the third carry-in route R3, in a state where the two sheets overlap each other, as illustrated in FIG. 11B, without causing the sheet P to pass through from the discharge roller 25. In addition, the succeeding sheet P1, which is carried into the third carry-in route R3 in this way, subsequently contacts with the stopper 61. Thereby, the punching process is performed for the succeeding sheet P1 by the punching unit 60, in a state where a position of the back end is regulated. It should be noted that when the punch hole is formed on the succeeding sheet P1 in this way, the sheet P that is a sheet after the punching process, on which the punch hole has been previously formed, has not reached the punch hole forming position, and thus the punch hole is not formed on this sheet P. In other words, if the sheet P after the punching process, for which the punching process has been performed, and the succeeding sheet P1 are simultaneously carried into the third carry-in route R3, the sheet P and the succeeding sheet P1 are shifted from each other and carried into the third carry-in route R3 so that the punching process is not performed for the sheet P.

Next, when the punch hole is formed on the succeeding sheet P1 in this way (Y in S204), it is determined whether or not the succeeding sheet P1 is the last sheet (S205). Then, if the succeeding sheet P1 is not the last sheet (N in S205), S200 to S204 are repeated. Moreover, if the succeeding sheet P1 is the last sheet (Y in S205), the discharge roller 25 and the buffer roller 27 are rotated forward (S206), and the sheet on which the punch hole has been formed, and the succeeding sheet P1 are discharged on the processing tray 29. It should be noted that, in a case of such a configuration, three or more sheets may also be simultaneously carried into the third carry-in route R3. In this case, the preceding sheets sequentially pass through the discharge roller 25 and are conveyed to the processing tray 29 by the forward rotation of the discharge roller 25 and the buffer roller 27.

As described above, in the present embodiment, the lateral registration unit 62 is provided on the upstream side in the sheet conveyance direction of the branch point BR which branches into the third carry-in route R3, and the punching unit 60 is provided in the third carry-in route R3, which is on a downstream side in the sheet conveyance direction, lower than the lateral registration unit 62. In addition, depending on the lateral shift amount of the sheet which has been sensed by the lateral registration unit 62, the punching unit 60 is moved in the width direction before the sheet reaches the punching unit 60. Thereby, the time for starting the punch hole forming operation can be shortened in comparison with the case where the lateral shift amount is sensed after the sheet reaches the punching unit, and subsequently, the punching unit is moved.

In other words, the side end position of the sheet is sensed by the lateral registration unit 62, and the punching unit 60 is moved in the width direction, depending on the side end position of the sheet which has been sensed by the lateral registration unit 62, before the sheet reaches the punching unit 60. Thereby, the punch hole forming operation can be started in a short time. As a result, productivity associated with the punching process in the sheet processing apparatus B is improved.

Moreover, the lateral registration unit 62 is provided on the upstream side in the sheet conveyance direction of the branch point BR which branches into the third carry-in route R3, and the punching unit 60 is provided in the third carry-in route R3. Thereby, the timing when the punching process for the succeeding sheet P1 is started can be advanced. As a result, the productivity associated with the punching process in the sheet processing apparatus B is improved.

Figure 11C:
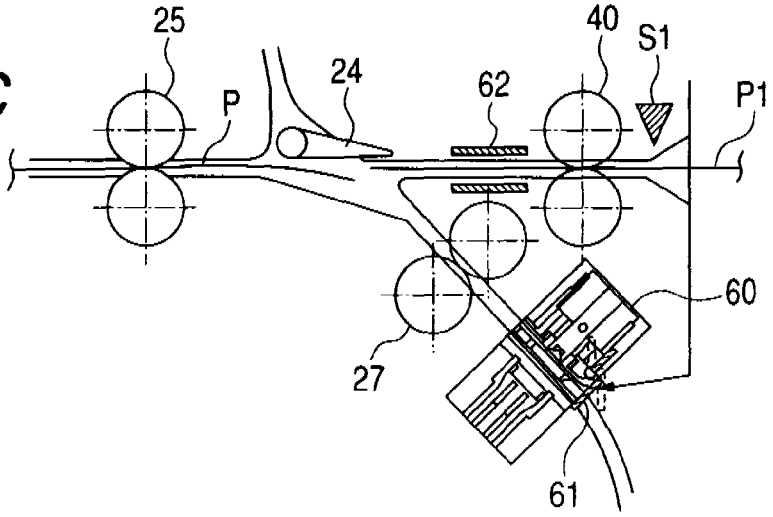

It should be noted that, in the above description, the succeeding sheet P1 is conveyed in the state where the succeeding sheet P1 partially overlaps the sheet P, toward the processing tray 29. However, the present invention is not limited thereto. For example, the sheet P can be conveyed to the processing tray 29 without contacting with the succeeding sheet P1, as illustrated in FIG. 11C, by accelerating circumferential speeds (conveyance speeds) of the discharge roller 25 and the buffer roller 27 higher than a circumferential speed of the inlet roller 40 after the punch hole is formed.

Moreover, in the above description, a case has been described where the lateral registration unit 62 is moved by the lateral registration motor M9, and the punching unit 60 is moved by the punch slide motor M10. However, the present invention is not limited thereto. For example, the lateral registration unit 62 and the punching unit 60 may be moved by the same driving source. Moreover, in the above description, the lateral registration sensors 64*a* to 64*e* are moved in the width direction so as to sense a side end portion of the sheet. However, the side end portion of the sheet may be sensed by using a two-dimensional line polarization sensor or the like, in a state where the sensor is fixed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-231018, filed Oct. 2, 2009, which is hereby incorporated by reference herein in its entirety.

What is claimed is:

1. A sheet processing apparatus which performs a punching process for a sheet, comprising:

a sheet conveyance route in which a sheet is conveyed;

a branched conveyance route which branches from the sheet conveyance route at a branch point;

a loading unit in which a sheet conveyed from the sheet conveyance route is loaded, the loading unit being arranged downstream of the branch point in a conveyance direction;

a sheet conveyance section which is able to convey a sheet in the conveyance direction and in a direction opposite to the conveyance direction, the sheet conveyance section conveying a sheet which has passed through the branch point, in the opposite direction, and carrying the sheet into the branched conveyance route;

a punching apparatus which performs a punching process for a sheet which has been carried into the branched conveyance route; and a processing section which performs a binding process on a sheet which has been carried into the branched conveyance route.

2. The sheet processing apparatus according to claim 1, further comprising a control section which controls the sheet conveyance section and the punching apparatus, wherein, after the control section causes the punching apparatus to perform the punching process for a sheet, when the control section causes the sheet conveyance section to convey the sheet for which the punching process has been performed, in the conveyance direction, the sheet for which the punching process has been performed is conveyed in a state where the sheet for which the punching process has been performed partially overlaps a succeeding sheet following the sheet for which the punching process has been performed.

3. The sheet processing apparatus according to claim 1, further comprising:

a control section which controls the sheet conveyance section and the punching apparatus; and an upstream sheet conveyance section which is provided on an upstream side in the conveyance direction of the branch point, and conveys the sheet toward the branch point, wherein the control section controls the upstream sheet conveyance section, and after the control section causes the punching apparatus to perform the punching process for a sheet, the control section accelerates a conveyance speed at which the control section causes the sheet conveyance section to convey the sheet for which the punching process has been performed, in the conveyance direction, higher than a conveyance speed at which the control section causes the upstream sheet conveyance section to convey a succeeding sheet following the sheet for which the punching process has been performed.

4. The sheet processing apparatus according to claim 1, further comprising:

a sensing section which senses a side end position in a width direction, which is orthogonal to the conveyance direction, of a sheet; and a moving section which moves the punching apparatus in the width direction, depending on the side end position of a sheet which has been sensed by the sensing section, before the sheet reaches the punching apparatus.

5. The sheet processing apparatus according to claim 4, wherein the sensing section is provided further upstream in the conveyance direction than the branch point, in the sheet conveyance route.

6. The sheet processing apparatus according to claim 5, wherein the sensing section and the punching apparatus are moved in the width direction by the same driving source.

7. The sheet processing apparatus according to claim 1, further comprising a control section which controls the sheet conveyance section and the punching apparatus, wherein if the control section causes the sheet conveyance section to simultaneously carry a sheet for which the punching process has been performed by the punching apparatus, and a succeeding sheet following the sheet for which the punching process has been performed, into the branched conveyance route, the sheet for which the punching process has been performed and the succeeding sheet are shifted from each other and carried into the branched conveyance route so that the punching process is not performed for the sheet for which the punching process has been performed.

8. The sheet processing apparatus according to claim 1, wherein the branched conveyance route comprises a stopper which locks a sheet that has been carried in, and at a time of the punching process, a position of a sheet which has been carried into the branched conveyance route is regulated by the stopper to a position where the punching process is performed by the punching apparatus.

9. An image forming apparatus, comprising an image forming section which forms an image on a sheet, and a sheet processing apparatus according to claim 1 which processes the sheet on which the image has been formed by the image forming section.

10. The sheet processing apparatus according to claim 1, further comprising a binding section which performs a binding process for a sheet which has been loaded in the loading unit.

11. The sheet processing apparatus according to claim 1, wherein the processing section folds a sheet which has been carried into the branched conveyance route.

* * * * *